United States Patent [19]

Lambert, Jr.

[11] 4,085,520

[45] Apr. 25, 1978

[54] ANTI-POLLUTION GRAIN DRYING APPARATUS

[75] Inventor: Charles F. Lambert, Jr., Louisville, Ky.

[73] Assignee: Clayton & Lambert Manufacturing Company, Buckner, Ky.

[21] Appl. No.: 731,552

[22] Filed: Oct. 13, 1976

[51] Int. Cl.[2] ..... F26B 19/00

[52] U.S. Cl. ..... 34/79; 34/85; 34/179; 34/233; 55/467

[58] Field of Search ..... 34/58, 59, 173, 174, 34/79, 85, 233, 82, 168; 55/467; 98/115 R

[56] References Cited

U.S. PATENT DOCUMENTS

| | | | |
|---|---|---|---|
| 2,174,896 | 10/1939 | Sackett | 34/79 |
| 3,755,917 | 9/1973 | Lambert, Jr. | 34/233 |
| 3,897,228 | 7/1975 | Berz | 55/467 |
| 4,020,561 | 5/1977 | Mathews | 34/174 |

*Primary Examiner*—Kenneth W. Sprague
*Assistant Examiner*—James C. Yeung
*Attorney, Agent, or Firm*—Arthur F. Robert

[57] ABSTRACT

An anti-pollution grain drying apparatus comprising: a grain drying bin having a perforated floor through which hot air is blown upwardly for drying purposes; a rotary sweep mounted in the bin for counter-clockwise (CCW) sweep movement along the floor, during which its lag side continuously deposits wet grain as it rotates over the floor to form thereon a circular layer extending about 345° clockwise (CW) from the lag side of the sweep to the lead side thereof while its lead side continuously retrieves dried grain from the adjacent end of said circular layer on the floor; and an anti-pollution suction system operative to remove air-borne dust, from the dried grain being retrieved along the lead side of the sweep, and direct it into outside equipment which separates the air and dust, captures the dust and discharges the clean air into the ambient atmosphere.

10 Claims, 11 Drawing Figures

ANTI-POLLUTION GRAIN DRYING APPARATUS

CROSS REFERENCES TO RELATED APPLICATIONS

A related application has not been filed.

BACKGROUND OF THE INVENTION

1. Field of the Invention

This invention relates to the art of drying wet grain in a continuous manner and to the air pollution problem it creates.

2. Description of the Prior Art

The Francis U.S. Pat. No. 3,449,840 and the Lambert, Jr. U.S. Pat. No. 3,755,917 both disclose a grain drying apparatus of the continuous rotary sweep type. In this type of drier, the lag side of the sweep continuously deposits wet grain as it rotates, say counter-clockwise (CCW), over a circular perforated floor, to form a circular layer of grain extending clockwise (CW) on the floor from the lag side of the sweep to the lead side thereof. This circular layer of grain dries progressively from the lag side to the lead side of the sweep as hot air is blown upwardly through the layer. The lead side of the sweep continuously retrieves dried grain from the adjacent end of the circular layer. The exiting hot air, which is contaminated with dust, pollutes the ambient atmosphere.

SUMMARY OF THE INVENTION

Objects Of The Invention

The principal object of the present invention is to prevent a continuous grain drier from polluting the atmosphere with dust.

Another important object is to provide a continuous grain drier with a simple and effective antipollution apparatus for retrieving the air-borne dust within the drier bin, separating the dust from the air and discharging relative clean air into the atmosphere.

Statement Of The Invention

I have found that a deposit of wet kernels of corn in the drier creates no dust problem; that, as a static layer of such corn is progressively orbited and dried in the drier, there appears to be no appreciable dust discharged from it into the exiting hot air; and that the contamination of the hot exiting air with dust occurs in the retrieval area, i.e. as such corn is retrieved from the perforated floor and in the region approaching and adjacent to the retrieval or lead conveyor. Apparently, in the retrieval area, the individual grains of corn are mixed, shuffled and rubbed together causing dirt, chaff, beeswing (i.e. the husks which separate from the kernels), fines and other light materials to become airborne. The same is true of other grains but we mention corn kernels throughout this application to promote clarity by way of concrete example.

I have solved this pollution problem and achieved the above-stated objects of the present invention by an anti-pollution suction system for removing and capturing air-borne dust coming from the grain in the vicinity of the lead side of the sweep. More particularly, the suction system comprises: a suction chamber orbitally carried by the rotating sweep in position to embrace the dusty air created in the retrieval area; a conduit connection between an outlet in the orbiting dust chamber and an inlet in an outside dust separator; and means for suctioning the dusty air from the suction chamber and conducting it to the dust separator, which separates the dust from the air, captures the separated dust and discharges relatively clean separated air preferably into the atmosphere.

BRIEF DESCRIPTION OF THE DRAWINGS

The invention is illustrated in the accompanying drawings wherein.

DESCRIPTION OF THE PREFERRED EMBODIMENT

Figure 1:
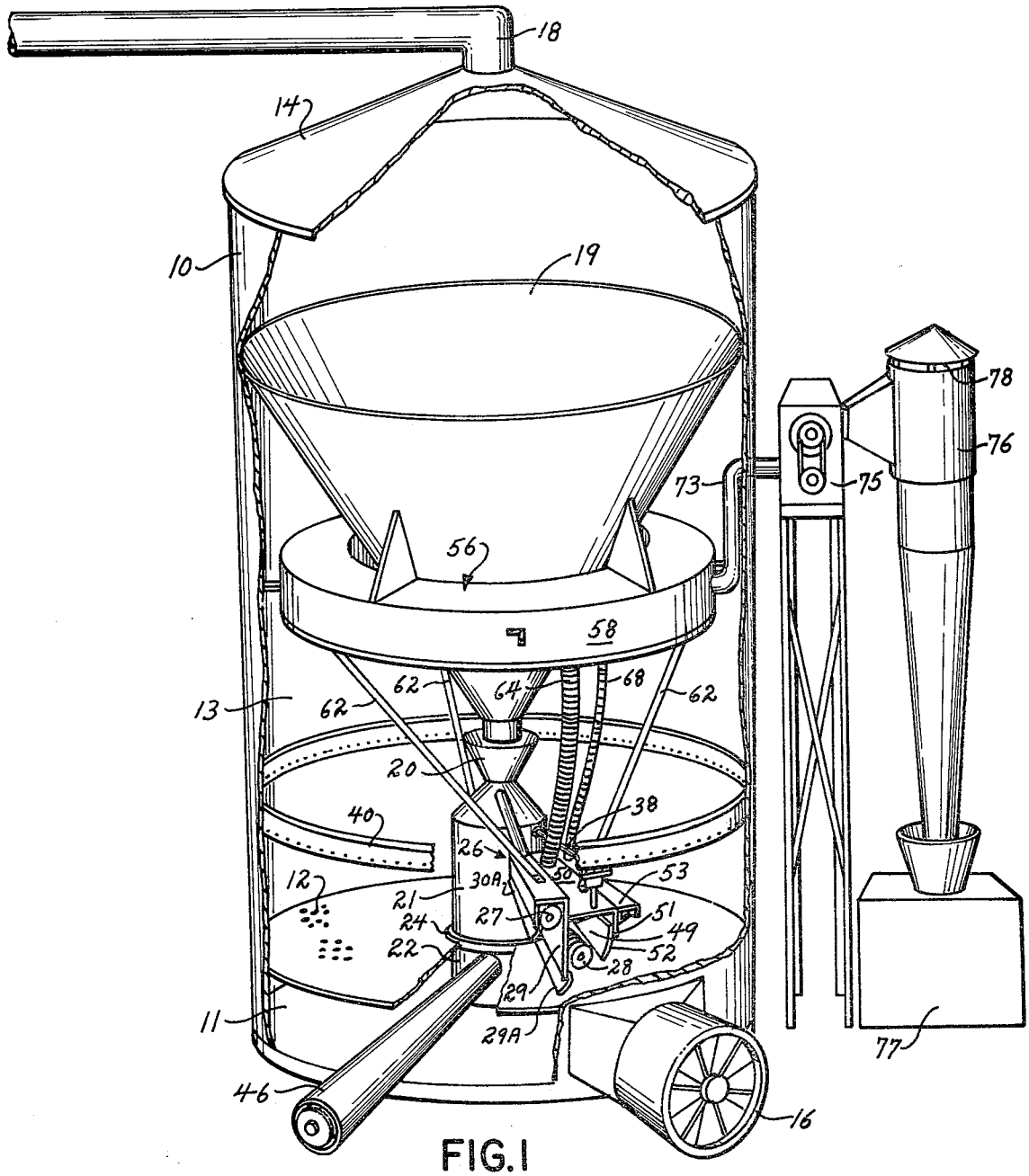
FIG. 1 is a partly broken elevational view of an anti-pollution grain drying apparatus made in accordance with my invention.

The structure illustrated comprises: a Francis-type grain drying apparatus; and anti-pollution means.

The Grain Drying Apparatus

The grain drying apparatus conventionally comprises: a grain bin; grain drying means; wet grain feed means; a rotary sweep; sweep drive means; and sweep support means.

The grain bin 10 has a bottom plenum chamber 11 under a perforated partition or floor 12 separating the plenum chamber 11 from an upper drying chamber 13, having one or more wall openings (not shown) for discharging the hot moisture-laden air into the ambient atmosphere. The top of the grain bin is covered by a conical roof 14.

The grain drying means simply comprises a blower 16 mounted to blow atmospheric air through a heater (not shown) into the bottom plenum chamber 11 to establish a continuous flow of hot drying air from the bottom plenum chamber successively through the floor 12, a grain layer on the floor 12, the drying chamber 13 and the air discharge opening in the bin wall.

The wet grain feed means includes: an inlet conduit 18, feeding grain to and downwardly through the center of the conical roof 14; a wet grain hopper 19, mounted on the interior bin walls to receive the incoming wet grain; and a funnel-mouthed conduit 20 positioned to receive wet grain from hopper 19 and to feed that grain into the lag side of the rotary sweep.

The funnel-mouthed conduit 20 is spaced downwardly from the lower end of hopper 19 and mounted on the conical roof of a rotary cylinder 21, which is concentric to the axis of the sweep and rotates therewith and which cooperates, at the floor level of the bin, with a stationary cylindrical bucket 22 to form a center well 23. A suitable bearing 24 is interposed between the bottom of rotary cylinder 21 and the top of stationary bucket 22 to facilitate relative rotation therebetween as the rotary cylinder 21 rotates with the rotary sweep.

The rotary sweep 26, comprises: a wet grain distributing conveyor 27 on the lag side of the sweep; a dry grain retrieving conveyor 28 on the lead side thereof; a horizontally elongate center wall 29 arranged vertically between and separating the lag and lead conveyors 27, 28; and a radially-elongate leveling wall 30, on the lag side of the lag conveyor 27. While the sweep may be arranged to rotate horizontally in sweep fashion in either direction, for the sake of clarity, it will be referred to throughout this application as moving counter-clockwise (CCW).

The drive means for the sweep comprises a drive motor 32, having a drive gear 33 connected through chain 34 to each of the following: the driven end 35 of one gear box, which is connected to the lag conveyor 27; the driven end 36 of another gear box, which is connected to the lead conveyor 28; and the driven end 37 of sweep drive shaft 38, which is connected at its outer end through a third gear box to a tracking sprocket 39. The sweep is rotated by the engagement of sprocket 39 with the sprocket holes in the stationary wall-mounted annular tracking ring gear 40.

The inner and outer ends of the sweep 26 are suspended for such rotation upon a center post assembly and an outer roller-bracket assembly. The center post assembly comprises: a stationary center post 42, which is anchored upon the ground or the base of the bin to project upwardly therefrom through the closed bottom of centrally-disposed stationary bucket 22 into the center well 23; and a rotatable post 43 mounted on center post 42 and arranged to support drive assembly parts 32–37 for rotation with the sweep. The outer roller-bracket assembly comprises: two spaced pairs of rollers 44 mounted on the top sides of the inner and outer bottom flanges of ring gear 40; and a double armed bracket 45 extending from said rollers downwardly to the sweep frame to which they are rigidly secured.

In conventional operation, the wet grain flows successively through inlet conduit 18, wet grain hopper 19, funnel-mouthed conduit 20 into the lag side of the sweep 26. This incoming grain passes downwardly around the inner end portion of the lag conveyor 27, between the center and leveling walls 29, 30, and drops upon the perforated floor 12. It ultimately piles upwardly to the lag conveyor 27 which moves it radially toward the outer wall of the bin until a solid wall of grain rises from the floor throughout the radial length of the lag conveyor.

We now assume: that the apparatus has been operated sufficiently to deposit wet grain on the floor in a pile extending upwardly to the reach of the lag conveyor throughout its entire length; that a layer of grain extends circularly from the leveling wall 30 CW (clockwise) around the perforated floor 12 to the retrieving or lead conveyor 28; and that such layer has dried progressively clockwise from its original wet state adjacent lag conveyor 27 to a satisfactorily dry state adjacent lead conveyor 28.

With the drive means energized, the drive motor 32 will rotate the sweep drive shaft 38 to cause its tracking sprocket 39 to track along the holes in the tracking ring gear 40 and thus rotate the sweep CCW (counter-clockwise) as indicated in FIGS. 1–4. At the same time, the drive motor 32 will not only rotate the lag conveyor 27 to distribute the incoming wet grain outwardly along its length but also rotate the lead conveyor 28 to retrieve dry grain along its length and direct it inwardly to the interior of the center well 23 into which it is discharged. The dried grain within well 23 is carried by a bottom discharge conveyor 46 radially outward through the plenum chamber 11 and the outer wall of the bin and ultimately discharged into a desired receiver.

While the aforesaid "Francis" drier has been illustrated and described, any other suitable continuous drying apparatus may be employed such as that shown in the aforesaid Lambert, Jr. U.S. Pat. No. 3,755,917.

The Anti-Pollution Means

As the lead conveyor 28 rotates vertically about its long horizontal axis and sweeps horizontally CCW about the vertical rotational axis of the sweep, the individual grains of corn moving, in the retrieval area under the influence of the drying air and the lead conveyor 28, are "fluidized," mixed, shuffled, and rubbed together causing dirt, chaff, beeswings, fines and any other relatively lightweight materials in such corn to become airborne. Such materials become air-borne not only in the space along the length of lead conveyor 28 but also in the space immediately preceding that conveyor where the corn has become "fluidized," i.e. dry enough to be shuffled or otherwise moved by the upwardly flowing stream of hot dry air. My anti-pollution suction system, which removes this dusty air and recovers the dust in it, comprises: a suction chamber orbitally carried by the sweep; conduit means connecting the orbital chamber to an outside dust separator; and means for suctioning air from the chamber and directing it through the separator.

The suction chamber 49 comprises: a flat-top wall 50 suitably spaced above the retrieving or lead conveyor 28 and arranged to extend radially from the centrally disposed rotary cylinder 21 to a point short of the outside wall of the bin and to extend horizontally CCW or forwardly from the conveyor-separating wall 29 to a suitable point beyond the lead conveyor; and vertical end wall and front-side wall means closing opposite ends and the front side of the suction chamber from the top wall 50 down to the corn layer on the lead side of the lead conveyor. The end and front edges of the top wall 50 have a more or less continuous downwardly turned flange 51 to which the opposite end walls and the front side wall of the suction chamber are secured. These walls are preferably composed of a flexible material, preferably canvas; hence, a canvas curtain 52 is secured to depend from the top wall flange 51 sufficiently to close the ends and front side of the suction chamber. This canvas is weighted along its bottom edge as exemplified by ends weight 52A in FIG. 4.

I have also found that, as the weighted bottom edge of the front side of curtain 52 sweeps CCW in contact with the somewhat dry corn, it and the grain-fluidizing air creates dust on the lead side of the curtain 52; hence, the lead side of the curtain is provided with a suction nozzle 53 mounted on flange 51.

The conduit means, connecting the orbital suction chamber to an outside dust separator, comprises: a movable 1st conduit section mounted to rotate with the sweep; and a stationary 2nd conduit section extending from the movable section in the bin to the equipment outside of the bin. The connection, between these relatively movable 1st and 2nd conduit sections, is effected through a hollow coupler in the form of a circular hollow "donut" casing 56 which surrounds the axis of the sweep in spaced relation thereto.

The donut casing comprises: a movable circular wall part containing the outlet terminus of the sweep-mounted movable section; and a stationary circular wall part containing the inlet terminus of the stationary section. This casing 56, which may be of any suitable cross-section, preferably square, has a flat movable circular bottom wall 57 and a hopper-supported stationary circular tunnel 58 preferably composed of opposite side walls and a top wall. The bottom wall 57 contains the outlet terminus of the movable 1st conduit section while one wall of the tunnel 58, preferably its outer sidewall, contains the inlet terminus of the stationary 2nd conduit section.

The lower edges of circular tunnel 58 are turned horizontally inward toward each other to provide opposed circular flanges 59 which cooperate with a circular spacer 60 and disc-like ring 61, both bolted to flange 59, to form a pair of oppositely-disposed horizontally-elongate vertically-narrow channels which open horizontally toward each other. The bottom wall 57 rests upon ring 61 when the suction is off and presses upwardly against flange 59 when the suction is on. The bottom wall is rotated and also supported at intervals along its circular center by two or more sweep-carried brace and tow bars 62. Each margin of bottom wall 57 cooperates with channel-forming parts 59–61 to form a tortuous path, which restricts the leakage of air into the donut casing 56.

The movable 1st conduit section includes one conduit, preferably in the form of flexible tube 64 extending from a suction chamber outlet opening 65 in wall 50 to an opening 66 in the bottom wall 57 of donut casing 56. It also includes another like flexible conduit 68, of smaller diameter, extending from an outlet opening 69 in nozzle 53 to another opening 70 in the bottom wall 57 of casing 56. If desirable or necessary, suction may be applied directly to the center well 23 by connecting a suitable opening in rotary cylinder 21 either to suction chamber 49 or to another opening in the bottom wall 57 of the donut casing 56.

The stationary 2nd conduit section includes a tubular metal conduit 73 extending from an outlet 74 in the outlet terminus or tunnel 58 of donut casing 56 to the inlet of the outside equipment which includes a blower 75 and a cyclone dust separator 76. The blower 75 preferably is interposed between the outer end of stationary conduit 73 and the cyclone 76 so as to suction the dusty air from suction chamber 49 and nozzle 53 and blow that dusty air into the cyclone. The cyclone removes the dust and collects it in its bottom dust storage box 77 while contemporaneously discharging the clean air from its top 78. The collected dust is normally composed of a percentage of organic edibles high enough to permit use as a stock feed; hence, it may be used or sold.

Since the foregoing makes the operation of the grain drying apparatus and the anti-pollution means clear, it should suffice to say: that the rotary sweep, in rotating CCW, tends to lengthen the wet end and contemporaneously remove and shorten the dry end of a continuous layer of grain extending CW from the lag side of the sweep to the lead side thereof; that the dust created in the vicinity of and along the length of the retrieving lead auger is initially confined to the suction chamber 49 by the walls thereof; that the air-borne dust in suction chamber 49 is suctioned therefrom, successively through the movable sections 64, 68, 57 and stationary conduit sections 58, 73, by blower 75 and then blown into the cyclone separator 76 which directs the separated dust into the dust collection box 77 and discharges the clean air through its air outlet 78 into the ambient air; and that the dust, on the lead side of the curtain 52, is contemporaneously suctioned by the blower through the movable section of the conduit connection into the inlet terminus or tunnel 58 of the stationary section where it joins the dusty air from suction chamber 49 and flows with that air to the cyclone separator.

Figure 7:
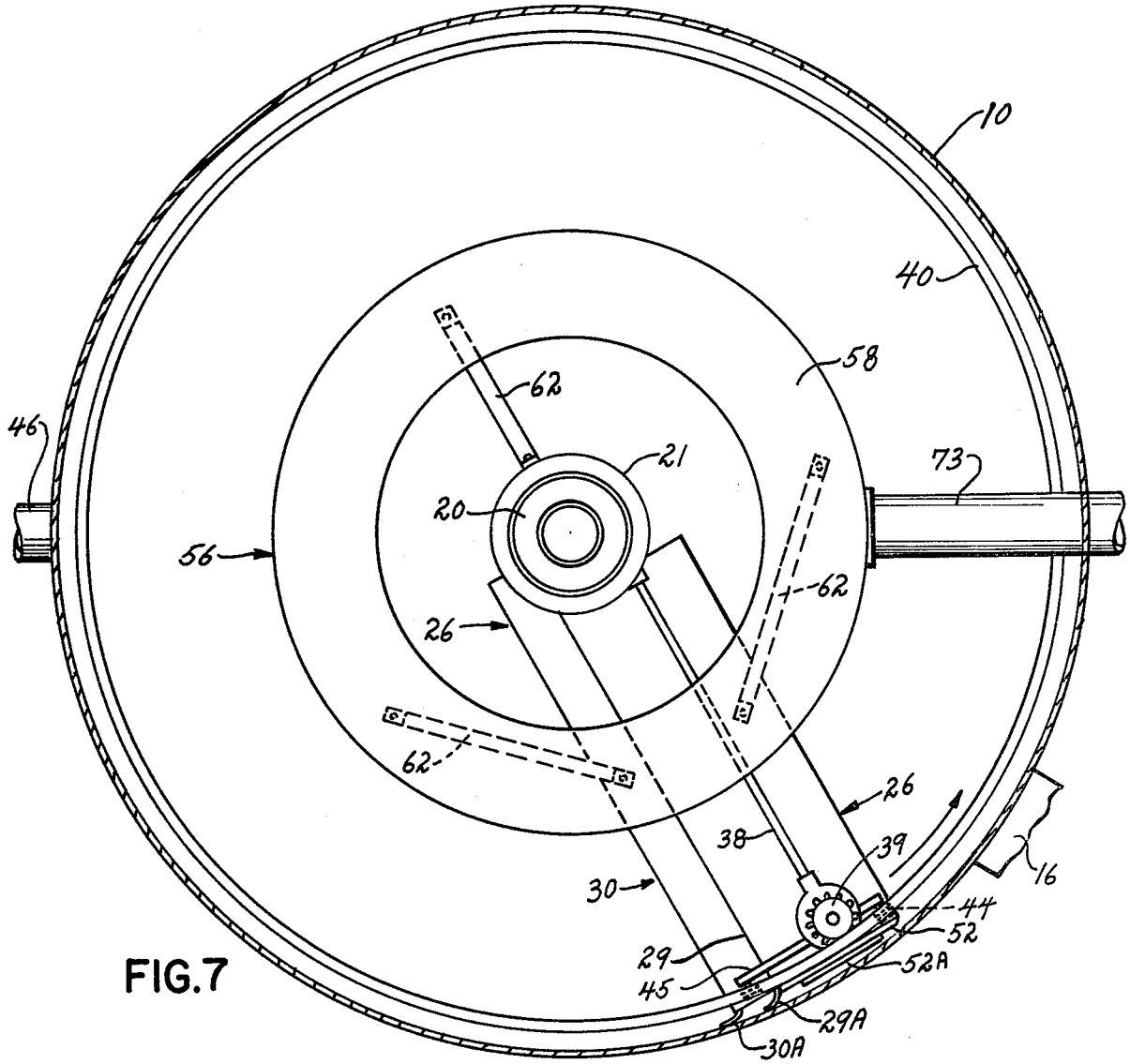
FIG. 7 is a view corresponding to FIG. 3 but simplified for clarity purposes.
Figure 8:
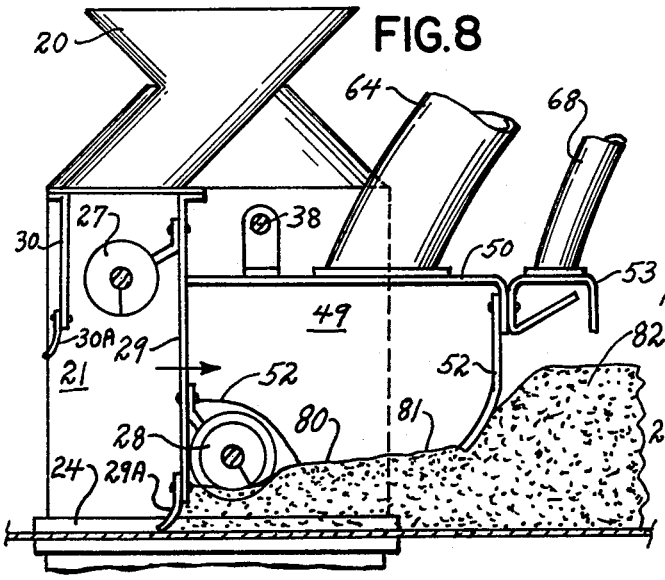
FIG. 8 is a vertical sectional view corresponding to FIG. 4, but arranged to show the level of the corn in the dust chamber and in the approach to the front wall of the dust chamber.

In FIGS. 7 and 8, it will be seen that the center separating wall 29 carries, at the lowermost portion of its outermost end, a scraper 29A which scrapes against the bottom 12 and the inside surface of the wall of the bin 10. The leveling board 30 also is provided with a similar scraper 30A.

In FIG. 8, it will be seen that the thickness of the corn layer on the lead side of the front curtain 52 is greater than it is within the suction chamber 49. The corn adjacent the lead conveyor 28, which is designated by the numeral 80, is not only subject to movement by the hot dry air, but also by the lead conveyor 28. The term "retrieval area" has been used in this application to embrace corn 80, the fluidized corn 81 on the dust chamber side of its front wall and the fluidized corn 82 under the influence of the suction nozzle 53. The granules of dry corn tend to flow easily, relative to one another, whereas the kernels of wet corn remain relatively static. Whenever the dry corn moves, it creates dust; hence, the fluidized corn 81–82 will create dust. The dust created at 80 and 81 is captured within the dust chamber 49. The dust coming from corn at 82 will, for the most part at least, be captured by the nozzle 53.

Figure 9:
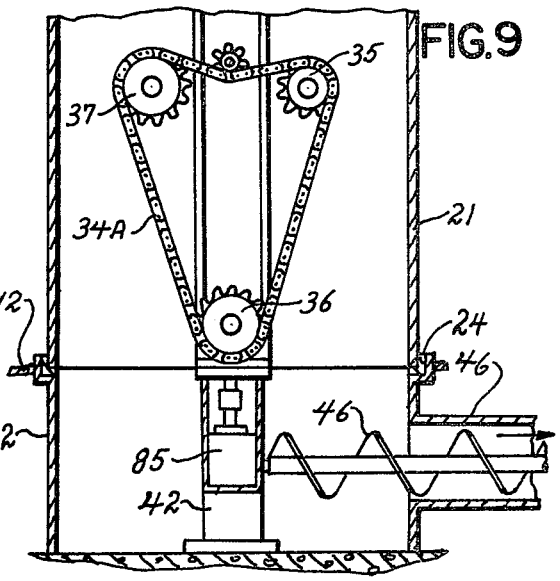
FIG. 9 shows a modified drive mechanism within the rotary cylinder 21.

In the modification shown in FIG. 9, the bottom discharge conveyor 46 under the horizontal partition 12 is driven at its outer end by a drive motor 47, which is also used to drive gears 35–37 by connecting the inner end of the shaft of conveyor 46, through gear box 85, to gear 36 and interconnecting lag conveyor drive gear 35, lead conveyor drive gear 36 and sweep drive gear 37 by a single drive chain 34A. This arrangement has the advantage of keeping the electrical equipment outside of the bin, which is considered very desirable.

Figure 10:
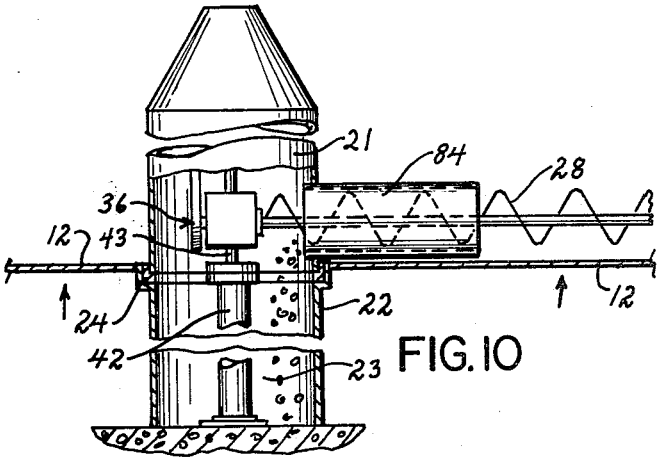
FIG. 10 shows a supplementary structure on the retrieving conveyor.

The supplementary structure shown in FIG. 10 comprises an open-ended sleeve 84 surrounding the retrieving conveyor 28 adjacent the cylinder 21 to baffle hot drying air coming upwardly through the floor 12 and thus prevent that air from blowing dried grain into cylinder 21 through the opening which receives the discharge end of the retrieving auger. Sleeve 84 tends to fill up with discharging dry grain creating an air-lock between the suction chamber 49 and the center well 23. This air-lock prevents the hot drying air from blowing dried grain into the center well. The grain metering characteristic of sleeve 84 also appears to reduce the horizontal distance between the minimum thickness of dried grain along the retrieving conveyor and the lead point, line or area at which the thickness of that grain layer begins to decrease as it approaches the retrieving conveyor. In other words, the distance between the thin grain layer at 80 (in FIG. 8) and the thicker grain layer at 82 is of one value without the sleeve 84 and of a substantially lesser value with the sleeve.

Figure 11:
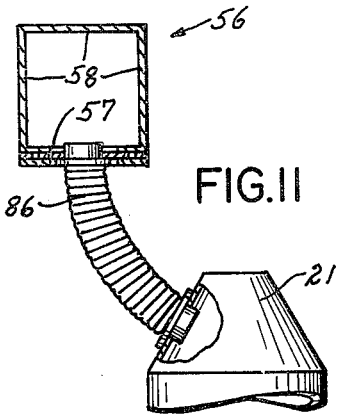
FIG. 11 shows a supplementary dust recovery structure.
Figure 2:
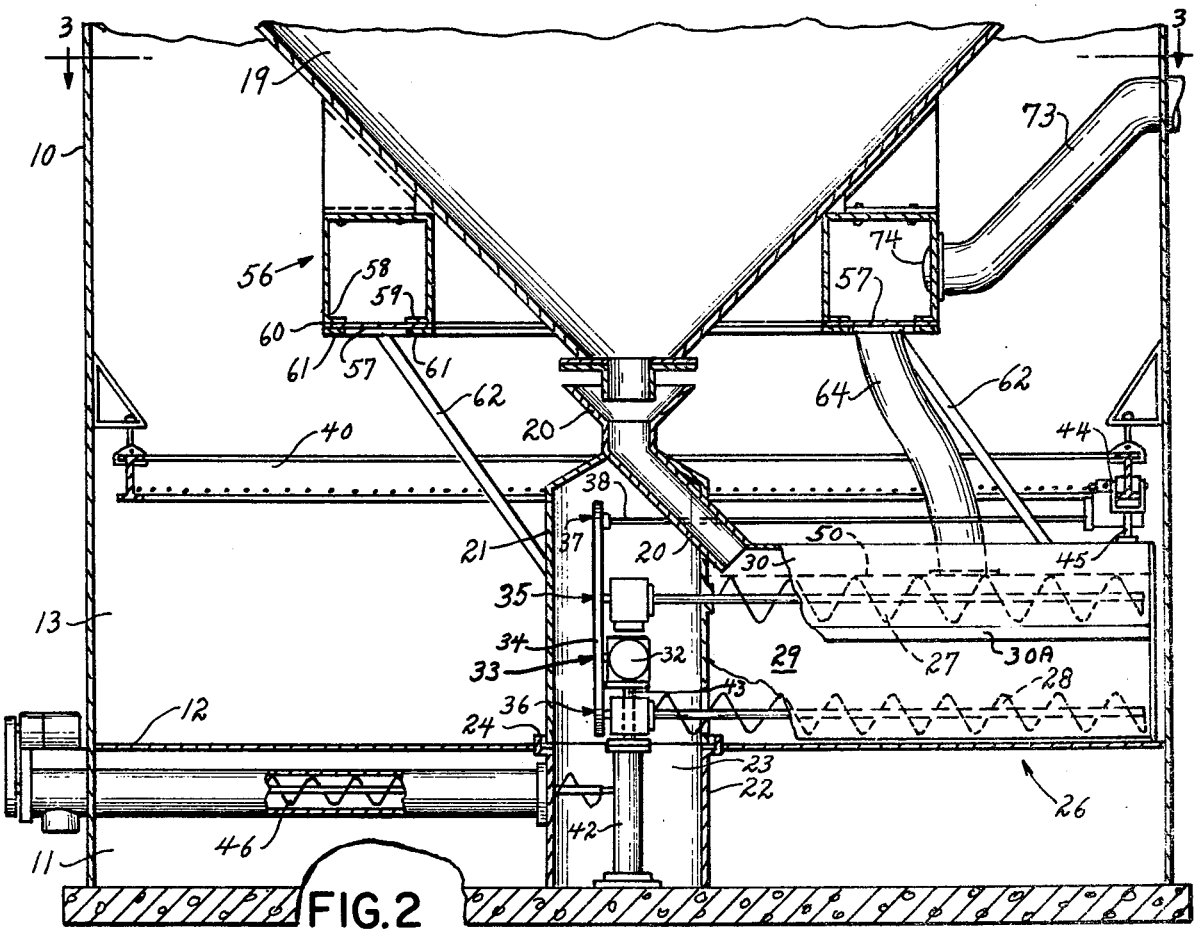
FIG. 2 is a central vertical sectional view, partly in elevation, showing the lower half of FIG. 1 on the lag side of a continuous grain drier of the type shown in the Francis Pat. No. 3,449,840.
Figure 3:
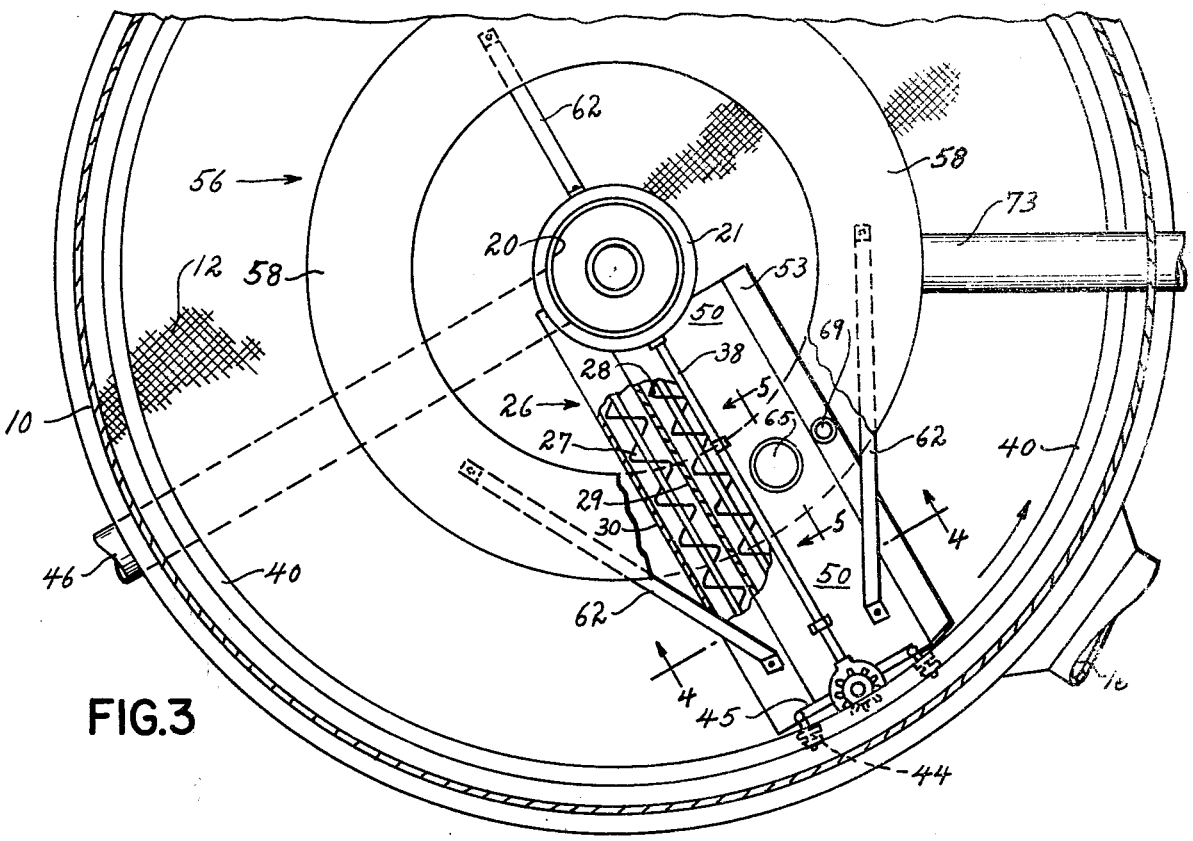
FIG. 3 is a section taken along lines 3—3 of FIG. 2 but omitting the upper wet-grain hopper.
Figure 4:
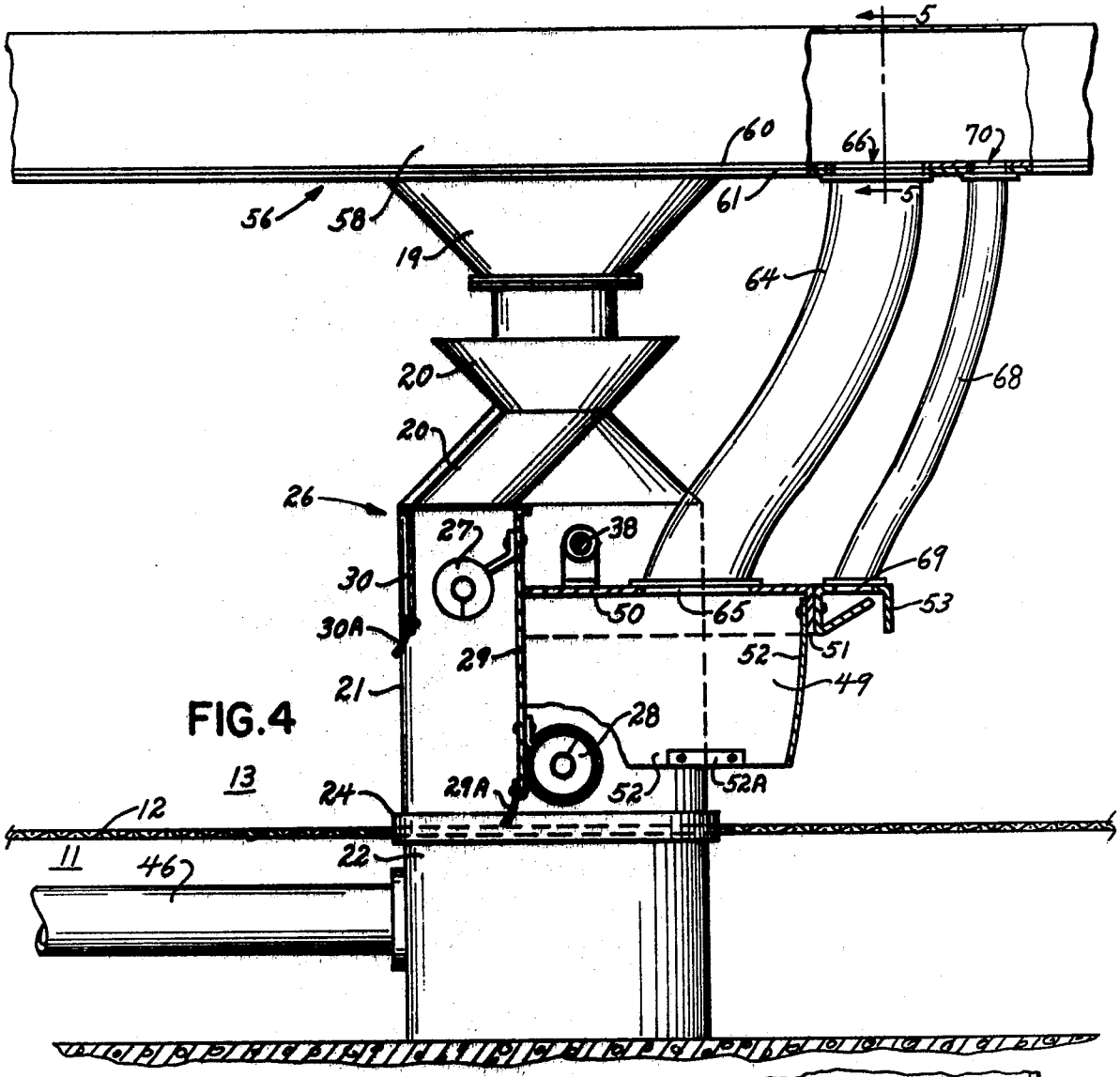
FIG. 4 is a vertical sectional view taken along lines 4—4 of FIG. 3.
Figure 5:
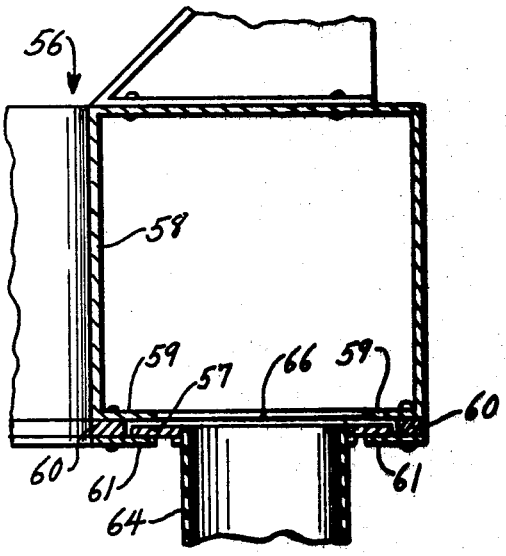
FIG. 5 is a vertical sectional view taken along lines 5—5 of FIG. 3 to show the connection of the movable section's outlet terminus with the stationary section's inlet terminus.
Figure 6:
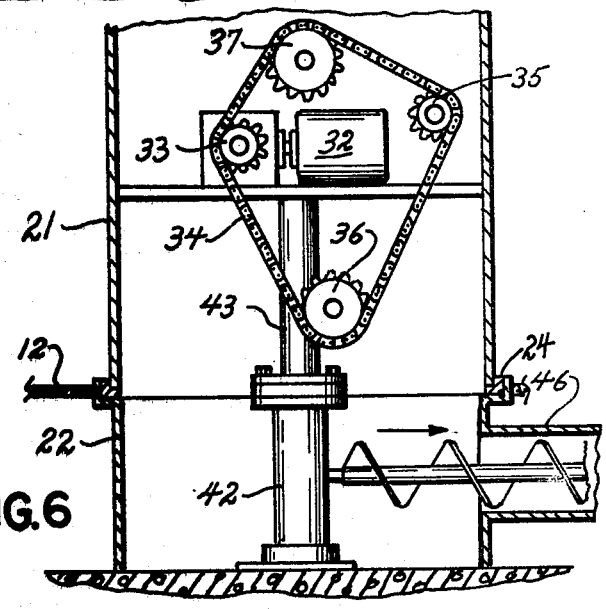
FIG. 6 is an elevational view of the drive mechanism contained in the center well, this view omitting the gear boxes for the lag and lead conveyors.

Again, in FIG. 10, the grain will be seen falling downwardly through the center well 23. As it falls, residual dust, still remaining in the grain, will become air-borne. In order to suction off dust released in the center well 23, the center cylinder 21 is connected into the suctioning system by a tube 86 connecting cylinder 21 into the donut casing 56, as seen in FIG. 11.

It will be understood that the present invention may be employed on batch driers. In fact, driers of the continuous type, such as the Francis drier illustrated in the drawings, may be operated as a batch drier by forming a circular layer of wet corn on the floor; drying that circular wet layer throughout its length; next removing the dried grain through retrieving lead conveyor 28 and the bottom discharge conveyor 46 while contemporaneously suctioning the dusty air and capturing the dust; and thereafter repeating such wet layer forming, hot-air drying, and contemporaneous dry corn removing and dust capturing operations as many times as may be necessary to finish each of the remaining batches. The invention may also be applied to driers of the type wherein a vertical layer of wet corn is fed downwardly between two perforated partitions, dried, either as a batch or continuously, by a horizontal flow of hot air, and retrieved in any suitable way by a dry corn retriever, such as a conveyor along the bottom of said partitions. The air-borne dust is suctioned from the vicinity of the retriever and directed into dust-separating equipment.

Having described my invention, I claim:

1. An anti-pollution grain drying apparatus comprising:

A. a grain drying bin having a perforated floor through which hot air is blown upwardly for drying purposes;

B. a rotary sweep mounted in the bin for sweep movement over the floor, said sweep having distributing means on its lag side for distributing wet grain over the floor and radially-extending retrieving means on its lead side for removing dried grain from the floor;

C. means for feeding wet grain to said distributing means;

D. means for receiving dried grain from said retrieving means and conveying said grain outside of the bin; and E. an anti-pollution suction system for removing and capturing dust coming from grain adjacent the sweep, said system including 1. a suction chamber embracing dust created adjacent the sweep, and 2. anti-pollution means for suctioning air and dust from the suction chamber and conducting it into equipment for separating dust from the air and capturing the dust, said anti-pollution means having intercommunicating conduits including a. a 1st conduit carried by the sweep for rotation therewith, and b. a 2nd conduit stationarily supported within the bin.

2. The apparatus of claim 1 wherein:

A. said suction chamber has a front or lead wall; and

B. said suction system includes supplementary suction means for removing dust raised along the front side of said lead wall.

3. The apparatus of claim 1 wherein:

A. said suction system includes a hollow casing encircling the vertical axis of the sweep in spaced relation thereto, 1. said casing having a stationary part and a movable part which cooperate to enclose a passageway;

B. means for supporting the stationary part of the hollow casing within the bin; and C. means for supporting the movable part of said hollow casing upon the sweep for rotation therewith.

4. The apparatus of claim 3 wherein said suction system includes:

A. an air and dust conduit connecting an outlet opening in the suction chamber with an opening in said movable part for conveying air and dust from the chamber to said casing passageway; and B. outlet conduit means connecting an outlet opening in a stationary part of said hollow casing with said separating equipment for conveying air and dust from said casing passageway to said equipment.

5. The apparatus of claim 4 wherein:

A. said suction chamber has a front or lead wall; and

B. said suction system includes supplementary suction means for removing dust raised along the front side of said lead wall.

6. The apparatus of claim 5 wherein:

A. said supplementary suction means includes 1. a suction nozzle embracing dust created along the front side of said suction chamber's front wall, and 2. conduit means conveying air and dust from said nozzle to said casing passageway.

7. The apparatus of claim 3 wherein:

A. said movable part of the casing has opposite circular marginal edges;

B. said stationary part of the hollow casing form a circular tunnel having an endless opening; and C. support means on said stationary part rotationally supporting said movable part in a position closing said tunnel opening, said support means providing 1. one open circular U-shaped channel having its mouth positioned to receive the one marginal edge of the casing's movable part, and 2. another open circular U-shaped channel having its mouth positioned to receive the other marginal edge of the casing's movable part.

8. The apparatus of claim 1 wherein:

A. said sweep includes a center cylinder mounted on the sweep to rotate therewith in concentric relation to the vertical axis of sweep movement;

B. said retrieving means discharges in said center cylinder; and

C. an open-ended sleeve surrounds a portion of the retrieving means, said portion being adjacent said center cylinder.

9. The apparatus of claim 1 wherein:

A. said sweep includes a center cylinder mounted on the sweep to rotate therewith in concentric relation to the vertical axis of sweep movement;

B. said retrieving means discharges into said center cylinder; and

C. said suction system includes supplementary means for suctioning air and dust from the interior of said center cylinder.

10. An anti-pollution grain drying apparatus comprising:

A. a grain drying structure having a perforated partition through which hot air may be blown for drying purposes;

B. means for feeding wet grain to form a grain layer over the perforations of said partition, said means also including a rotary sweep;

C. means for drying the wet grain of said layer;

D. means for retrieving the dried grain of said layer, said means also including rotary sweep; and E. an anti-pollution suction system for removing and capturing dust coming from the grain within the confines of the sweep, said system including 1. means carried by the sweep for rotation therewith, said sweep-carried means including a. a suction chamber embracing dust arising from the grain within the confines of said sweep, and b. a suction chamber outlet, and 2. anti-pollution means for suctioning air and dust from the suction chamber through its outlet and conducting said air and dust into equipment for separating dust from the air and capturing the dust, said anti-pollution means including a. a conduit stationarily supported within the bin, and b. means maintaining said stationary conduit in continuous communication with said suction chamber outlet on the sweep.

* * * * *